US011439222B2

(12) United States Patent
Kim

(10) Patent No.: US 11,439,222 B2
(45) Date of Patent: Sep. 13, 2022

(54) SHAMPOO ASSISTING DEVICE

(71) Applicant: Hyoung-Sub Kim, Incheon (KR)

(72) Inventor: Hyoung-Sub Kim, Incheon (KR)

( * ) Notice: Subject to any disclaimer, the term of this patent is extended or adjusted under 35 U.S.C. 154(b) by 22 days.

(21) Appl. No.: 17/041,048

(22) PCT Filed: Jul. 15, 2020

(86) PCT No.: PCT/KR2020/009301
§ 371 (c)(1),
(2) Date: Sep. 24, 2020

(87) PCT Pub. No.: WO2021/261648
PCT Pub. Date: Dec. 30, 2021

(65) Prior Publication Data

US 2022/0015520 A1 Jan. 20, 2022

(30) Foreign Application Priority Data

Jul. 15, 2020 (KR) ..... 10-2020-0077650

(51) Int. Cl.

| | |
|---|---|
| ***A45D 44/10*** | (2006.01) |
| ***A45D 19/00*** | (2006.01) |
| ***A45D 19/10*** | (2006.01) |
| ***A47K 3/12*** | (2006.01) |

(52) U.S. Cl.
CPC ..... *A45D 44/10* (2013.01); *A45D 19/00* (2013.01); *A45D 19/10* (2013.01); *A45D 19/005* (2021.01); *A47K 3/125* (2013.01)

(58) Field of Classification Search
CPC ..... A45D 19/00; A45D 19/005; A45D 44/10; A47K 3/125
USPC ..... 4/519, 573.1–575.1, 658
See application file for complete search history.

(56) References Cited

U.S. PATENT DOCUMENTS

| | | | | |
|---|---|---|---|---|
| 4,389,740 | A * | 6/1983 | Henry | A47K 3/125 4/575.1 |
| 4,949,407 | A * | 8/1990 | Singer | A45D 44/10 4/519 |
| 6,038,713 | A * | 3/2000 | Grosse | A47K 3/125 4/573.1 |
| 6,243,890 | B1 * | 6/2001 | Yang | A47K 3/024 4/573.1 |
| 7,856,679 | B1 * | 12/2010 | Finell | A47K 3/125 4/573.1 |
| 2005/0283901 | A1 * | 12/2005 | Cheng | A45D 44/10 4/523 |

FOREIGN PATENT DOCUMENTS

KR 200180400 Y1 5/2000

* cited by examiner

*Primary Examiner* — Tuan N Nguyen
(74) *Attorney, Agent, or Firm* — Rabin & Berdo, P.C.

(57) ABSTRACT

The proposed is directed to a shampoo assisting device that is mounted on a wash basin, a bathtub, a sink, etc. with a simple configuration to allow the user to be shampooed while lying down. The shampoo assisting device includes a main body having a locking part provided on one side and a headrest part provided on the other side to support a user's head, and a first support protruding from a lower portion of the main body so as to be closely supported by a bottom surface of a wash basin.

9 Claims, 7 Drawing Sheets

SHAMPOO ASSISTING DEVICE

TECHNICAL FIELD

The present disclosure relates to a shampoo assisting device and, more particularly, to a shampoo assisting device that is mounted on a wash basin, a bathtub, a sink, etc. with a simple configuration to allow the user to be shampooed while lying down.

BACKGROUND ART

In general, when shampooing the hair in a beauty salon or the like, the assistant washes the user's hair while the user takes a posture lying down in a slightly inclined manner while looking at the ceiling so that the user's head is placed in the washroom of the washbasin such that the neck or head is supported in the washbasin.

At this time, the washbasin is provided with an insertion recess to support the user's neck, so that the user can take a comfortable posture.

On the other hand, various washbasin neck supports that can support the user's neck more comfortably in the washbasin have been proposed.

Korean Registered Utility Model No. 20-0180400 discloses a neck support structure for beauty washbasin having a central arcuate neck insert, the neck support structure including an arcuate insertion part formed of urethane rubber that is elastically fitted around the upper and lower surfaces of the neck insert to clamp the same; and a cushion part formed of sponge or urethane foam in an arbitrary shape, and integrally coupled to the circumferential surface of the insertion part to comfortably supports the user's neck.

However, the conventional neck support structure mainly focuses on the role of a support to support the neck, and there is inconvenience in use for those who need to support the neck and the occipital region at the same time.

For example, for a person with a neck injury or an elderly person with weak neck strength, the shampooer has to support the occipital region with one hand, which is difficult and uncomfortable.

In addition, the conventional neck support structure has a problem that it is difficult to apply to a variety of places because it is impossible to install in a household wash basin or bathtub.

DISCLOSURE

Technical Problem

Accordingly, the present disclosure has been made keeping in mind the above problems occurring in the related art, and an objective of the present disclosure is to provide a shampoo assisting device that is mounted on a wash basin, a bathtub, a sink, etc. with a simple configuration to allow the user to be shampooed while lying down.

Another objective of the present disclosure is to provide a shampoo assisting device that can be detachably attached to a wash basin so as to be used only during shampooing without interfering with the use of the wash basin, thereby providing the convenience during shampooing.

A yet another objective of the present disclosure is to provide a shampoo assisting device that can stably support the neck and occipital region while the user is lying down so that the user's physical power consumption is reduced, thereby alleviating the physical discomfort or pain of the elderly or the infirm such as patients, the aged, and children.

A still yet another objective of the present disclosure is to provide a shampoo assisting device that can be used to support a part of the body of an infant during washing.

Technical Solution

In order to achieve the above objectives, according to one aspect of the present disclosure, there is provided a shampoo assisting device including: a main body having a locking part provided on one side and a headrest part provided on the other side to support a user's head; and a first support protruding from a lower portion of the main body so as to be closely supported by a bottom surface of a wash basin.

Here, the locking part may include a concave neck support coupling portion at the upper center, wherein a neck support is coupled to the neck support coupling portion.

In addition, the first support may include a first protrusion protruding from a lower portion of the main body, and a first support member having a hook portion coupled to the first protrusion.

In addition, the first support member may have a first suction plate on one end side thereof.

In addition, the shampoo assisting device may further include a second support provided on a lower side of the main body so as to be closely supported on a step portion of the wash basin.

In addition, the second support may include: a second protrusion protruding from the lower side of the main body; a second support member coupled to the second protrusion; and a second suction plate provided on the second support member.

In addition, the locking part may be provided on a lower side thereof with a fixing portion to be seated and supported on the step portion of the wash basin.

Here, the fixing portion may include: a housing protruding from the lower portion of the main body; a pad coupled to a lower portion of the housing; and an elastic member provided inside the housing so as to be elastically supported between the pad and the main body.

In addition, the fixing portion may include: a housing formed to protrude from the lower portion of the main body and having a fitting hole formed in a bottom surface thereof; and a pad having on an upper end side thereof a ball joint coupled to the fitting hole of the housing.

In addition, the main body may be further provided with a guard portion at an edge thereof.

Advantageous Effects

According to the present disclosure, the shampoo assisting device is mounted on a wash basin, a bathtub, a sink, etc. with a simple configuration to allow the user to be shampooed while lying down.

In addition, the shampoo assisting device can be detachably attached to a wash basin so as to be used only during shampooing without interfering with the use of the wash basin, thereby providing the convenience during shampooing.

In addition, the shampoo assisting device can stably support the neck and occipital region while the user is lying down so that the user's physical power consumption is reduced, thereby alleviating the physical discomfort or pain of the elderly or the infirm such as patients, and children.

Furthermore, the shampoo assisting device can be used to support a part of the body of an infant during washing.

MODE FOR INVENTION

Figure 1:
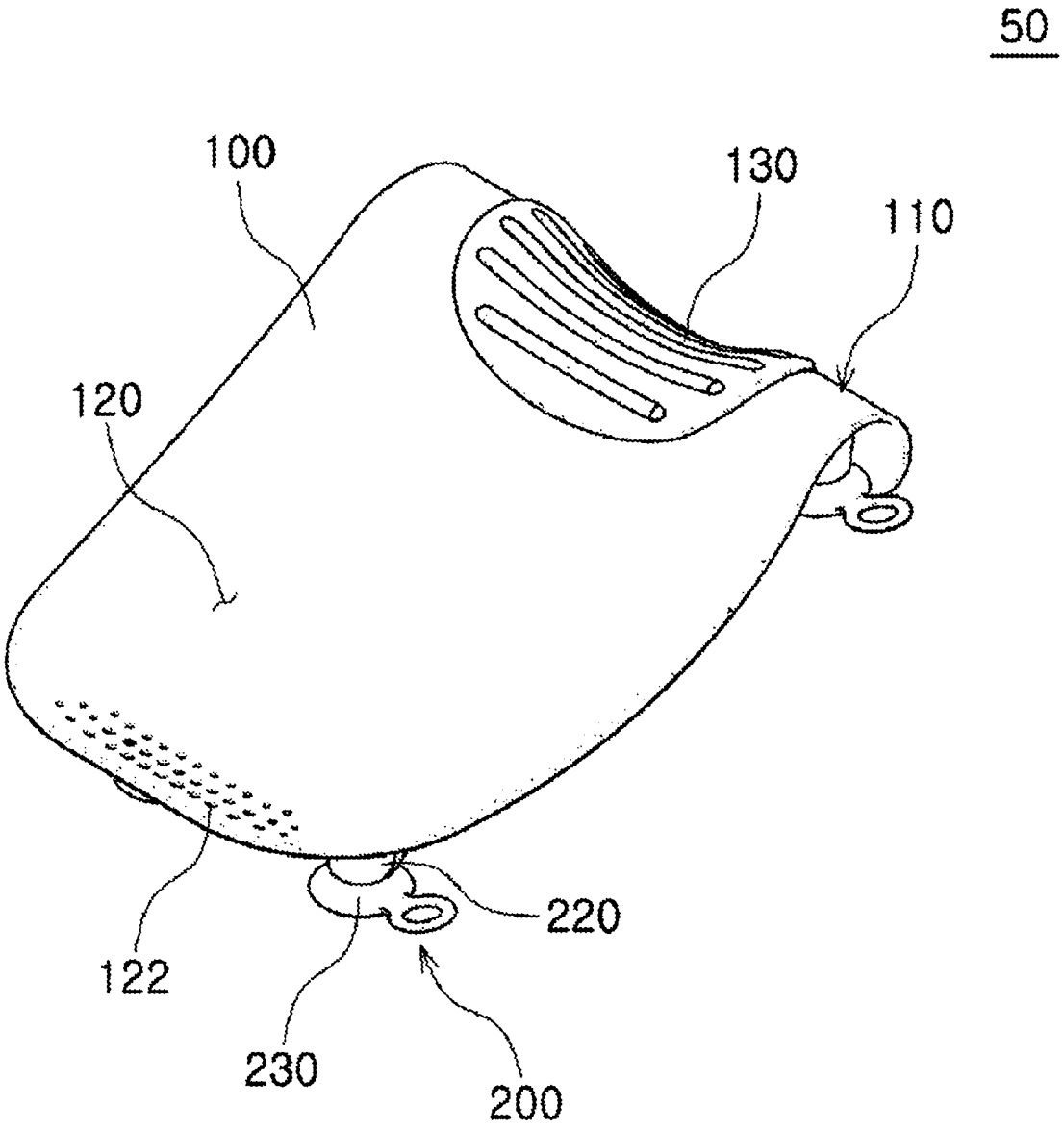
FIG. 1 is a perspective view illustrating a shampoo assisting device according to an embodiment of the present disclosure.

Hereinafter, exemplary embodiments of the present disclosure will be described in more detail with reference to the accompanying drawings. The same reference numerals are used for the same elements in the drawings, and duplicate descriptions for the same elements will be omitted. In addition, it should be understood that the present disclosure may be implemented in a variety of different forms, and is not limited to the described embodiments.

Figure 2:
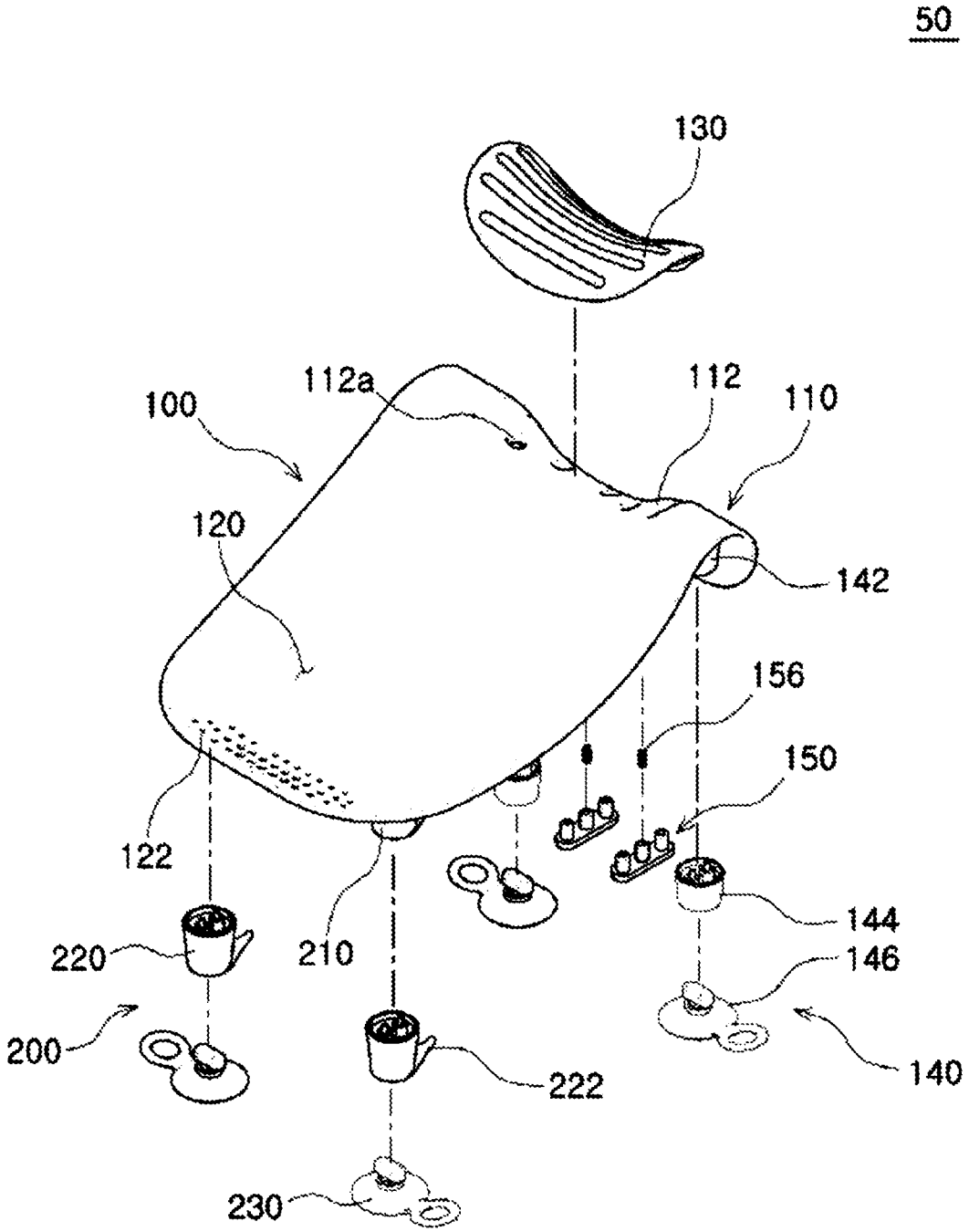
FIG. 2 is an exploded perspective view of the shampoo assisting device according to the present disclosure.
Figure 3:
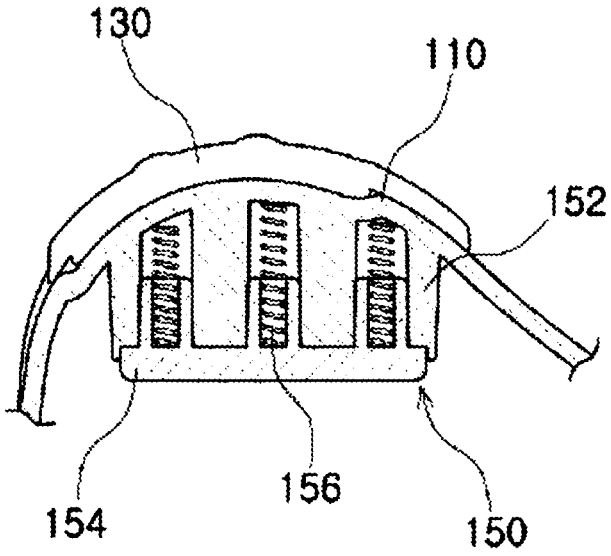
FIG. 3 is a view illustrating a part of the inner configuration of first and second support members of the shampoo assisting device according to the present disclosure.
Figure 4:
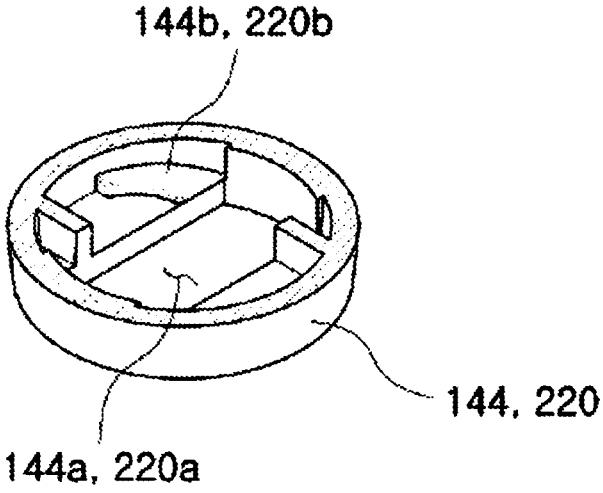
FIG. 4 is a cross-sectional view illustrating a fixing portion of the shampoo assisting device according to the present disclosure.
Figure 5:
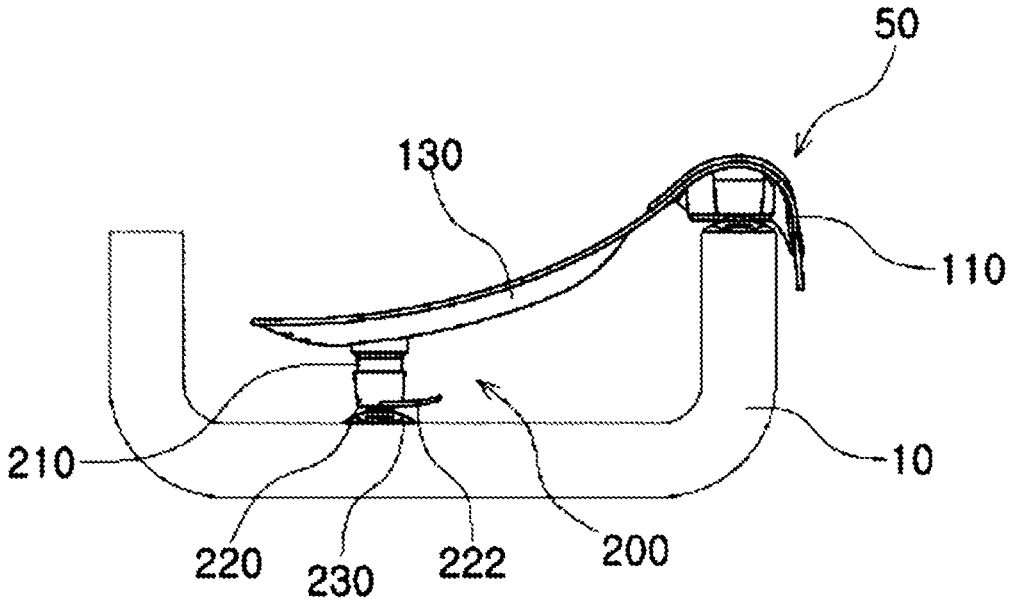
FIG. 5 is a view illustrating the state of the shampoo assisting device during use according to the present disclosure.
Figure 6:
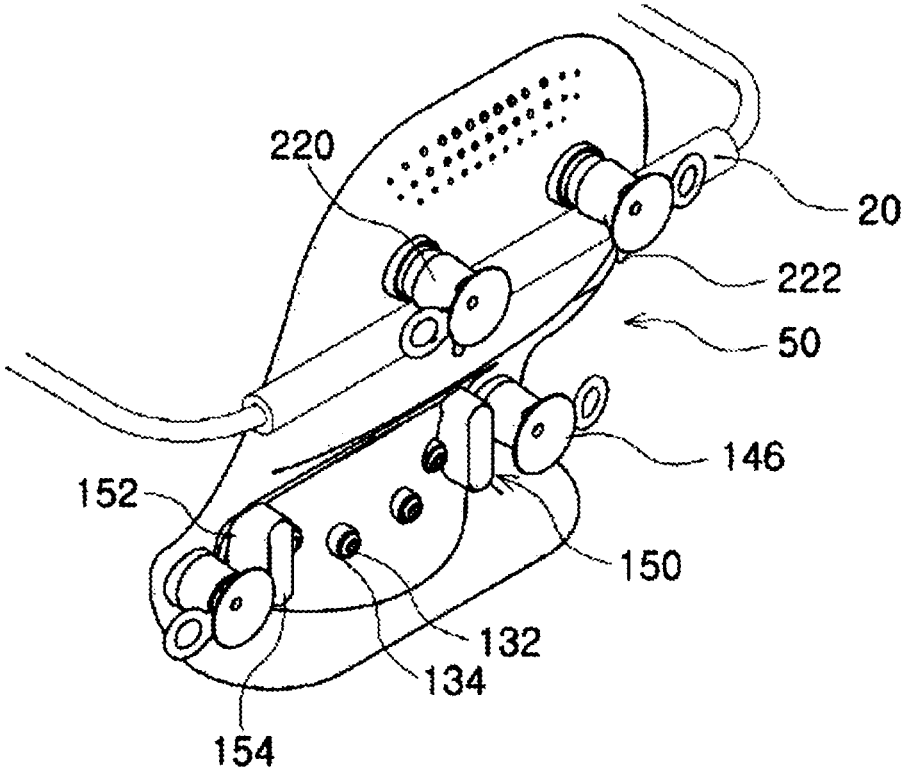
FIG. 6 is a view illustrating the state of the shampoo assisting device during storage according to the present disclosure.
Figure 7:
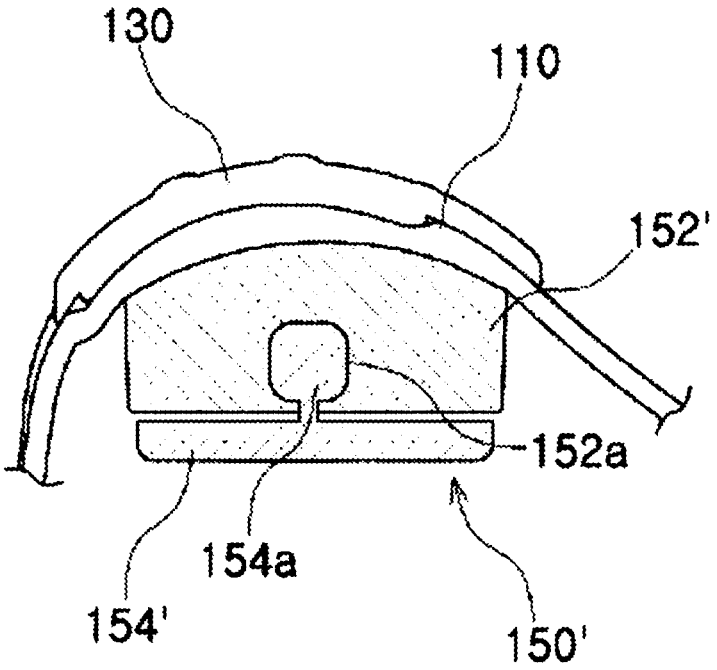
FIG. 7 is a view illustrating a shampoo assisting device according to another embodiment of the present disclosure.
Figure 8:
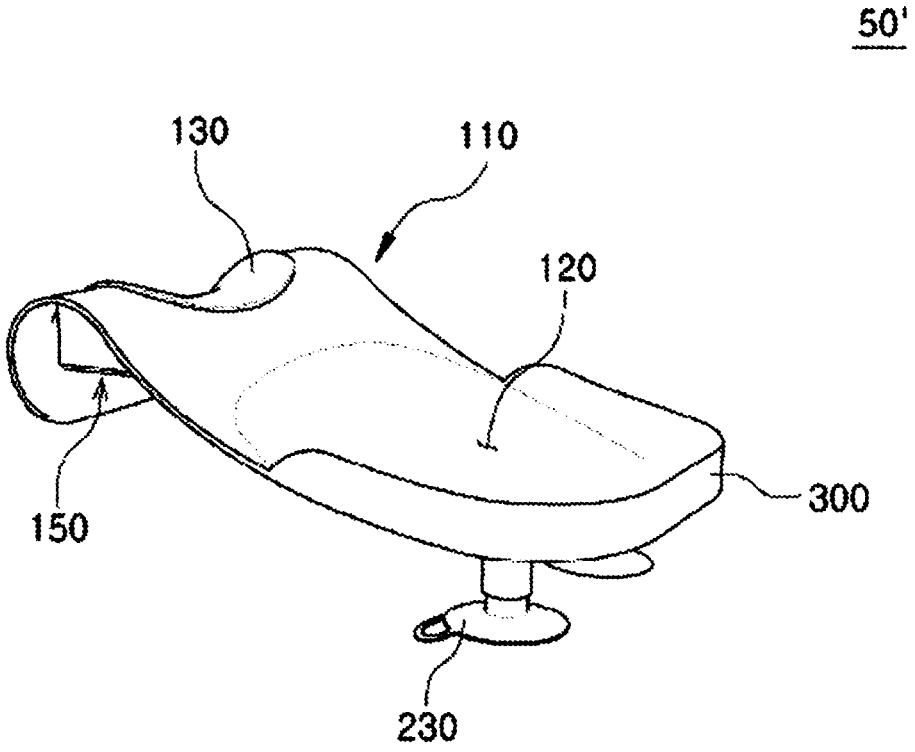
FIG. 8 is a view illustrating a configuration in which a guard is installed in the shampoo assisting device according to the present disclosure.

FIG. 1 is a perspective view illustrating a shampoo assisting device according to an embodiment of the present disclosure, FIG. 2 is an exploded perspective view of the shampoo assisting device according to the present disclosure, FIG. 3 is a view illustrating a part of the inner configuration of first and second support members of the shampoo assisting device according to the present disclosure, FIG. 4 is a cross-sectional view illustrating a fixing portion of the shampoo assisting device according to the present disclosure, FIG. 5 is a view illustrating the state of the shampoo assisting device during use according to the present disclosure, FIG. 6 is a view illustrating the state of the shampoo assisting device during storage according to the present disclosure, FIG. 7 is a view illustrating a shampoo assisting device according to another embodiment of the present disclosure, and FIG. 8 is a view illustrating a configuration in which a guard is installed in the shampoo assisting device according to the present disclosure.

The present disclosure relates to a shampoo assisting device 50 having a simple configuration mounted on a wash basin, a bathtub, a sink, etc. so that the user can be shampooed while lying down, wherein as illustrated in FIGS. 1 to 5, the configuration includes a main body 100 having a locking part 110 provided on one side thereof so as to be held on a step portion of a wash basin 10 (e.g. a bathtub, a sink, etc.) (hereinafter referred to as the 'wash basin') and a headrest part 120 extending inclined downwards from the locking part side and having a central concave portion to support a user's head; and a first support 200 protruding from a lower portion of the main body on the opposite side of the locking part 110 so as to be closely supported by a bottom surface of the wash basin 10.

In more detail, the main body 100 is manufactured by a method such as injection molding using a synthetic resin material. The locking part 110 is formed so that one side of the main body 100 has a convex shape so it can be installed by being held on the step portion formed on the edge of the wash basin 10.

Here, the locking part 110 includes a concave neck support coupling portion 112 at the upper center, and a neck support 130 is coupled to the neck support coupling portion 112 to support the user's neck.

At this time, the neck support coupling portion 112 has a coupling hole 112*a* in which the neck support 130 is coupled and the neck support 130 has on the back side thereof a coupling protrusion 132 having a step portion 134 such that the coupling protrusion 132 is inserted into the coupling hole 112*a* and is fixed by the step portion 134, so that the neck support 130 can be fixedly installed on the main body 100.

In addition, the coupling protrusion 132 is configured to include an internal reinforcing rib to maintain the coupling state with the coupling hole 112*a* more firmly.

Further, the headrest 120 is formed to be concave to support the user's head, so that a shampooer can shampoo the user's hair more comfortably without supporting the user's head. Here, since the user's head can be supported on the headrest 120, the user can take a more comfortable posture without straining of the neck.

In this case, a drain hole 122 is formed in the headrest 120 to allow drainage.

In addition, the first support 200 may include a first protrusion 210 protruding from a lower portion of the main body 100 on the opposite side of the locking part 110, and a first support member 220 having a hook portion 222 extending toward the locking part 110 side so as to be coupled to the first protrusion 210.

Accordingly, as illustrated in FIG. 6, the shampoo assisting device can be held and stored by hanging on a rod of a shelf 20 installed on the wall using the hook portion 222 of the first support member 220.

In addition, a first suction plate 230 is coupled to the first support member 220 so as to be adsorbed and fixed to the bottom of the wash basin 10 so that the main body 100 can be held in a more firm state.

Meanwhile, a second support 140 is provided under the locking part 110 so as to be closely supported on the step portion of the wash basin 10.

Here, the second support 140 includes: a second protrusion 142 protruding from the lower side of the main body 100; a second support member 144 coupled to the second protrusion 142; and a second suction plate 146 provided on the second support member 144.

Accordingly, the main body 100 can be closely held on the step portion of the wash basin 10 more firmly by the second suction plate 146 being sucked on the step portion of the basin 10.

Here, the first support member 220 and the second support member 144 have through-holes 220*a* and 144*a* through which the first and second suction plates 230 and 146 are coupled, respectively, and the through holes 220*a* and 144*a* of the first and second support members 220 and 144 are provided inside with fixed stepped portions 220*b* and 144*b* extending inclined from the through holes 220*a* and 144*a*.

Accordingly, the first and second suction plates 230 and 146 are configured such that the coupling portions are penetrated through the through holes 220*a* and 144*a* and then rotated along the fixed stepped portions 220*b* and 144*b* and fixed by the other side of the fixed stepped portion 220*b* and 144*b*, so that the first and second suction plates 230 and 146 can be held by the first support member 220 and the second support member 144 more firmly.

In addition, the first support member 220 and the second support member 144 are coupled and fixed to the first protrusion 210 and the second protrusion 142 by means of a screw or the like (not shown).

On the other hand, when the shampoo assisting device 50 is seated and supported on the step portion of the wash basin 10, the locking part 110 is subjected to high load so it is difficult to support the shampoo assisting device only with the second support 140. Accordingly, the shampoo assisting device is provided with a fixing portion 150, wherein the fixing portion 150 includes: a housing 152 protruding from the lower portion of the main body 100; a pad 154 coupled to a lower portion of the housing 152; and an elastic member 156 provided inside the housing 152 so as to be elastically supported between the pad 154 and the main body 100.

Accordingly, the elastic member 156 is pressed to correspond to the curved shape of the step portion of the wash basin 10 so that the height and angle of the pad 154 can be adjusted, thereby allowing the main body 100 to be more stably installed on the wash basin 10.

According to a shampoo assisting device 50' of another embodiment of the present disclosure, as illustrated in FIG. 7, a fixing portion 150' includes: a housing 152' formed to protrude from the lower portion of the main body 100 and having a fitting hole 152*a* formed in a bottom surface thereof; and a pad 154' having on an upper end side thereof a ball joint 154*a* coupled to the fitting hole 152*a* of the housing 152'.

At this time, the other configuration of the shampoo assisting device 50' according to the present disclosure configured as described above is the same as in the above-described embodiment, so a detailed description thereof will be omitted.

However, since the pad 154 is coupled to the housing 152 by the ball joint 154*a* so that the angle can be adjusted, the angle of the pad 154 can be adjusted to correspond to the stepped shape of the wash basin 10, thereby having the effect that the main body 100 can be stably installed on the wash basin 10.

Here, when the shampoo assisting device 50 according to the present disclosure is installed in a bathtub or the like, the shampoo assisting device can be fixedly installed on the step portion of the bathtub only by the second support 140 and the fixing portion 150 or 150 because the first support 200 is not used due to the depth of the bathtub.

In addition, according to the present disclosure, the shampoo assisting device 50 may be used to support a part of the body of the infant when washing the infant.

On the other hand, as illustrated in FIG. 8, the shampoo assisting device 50 according to the present disclosure is further provided with a guard portion 300 provided on the edge where the headrest part 120 of the main body 100 is formed to prevent the user's hair from flowing down.

Here, the guard portion 300 may be integrally formed during injection manufacturing of the main body 100, or alternatively, the guard portion 300 may be provided on an inner circumferential surface thereof with a coupling groove (not shown) in a shape corresponding to the outer circumferential surface of the main body 100 so as to be detachably coupled to the outer circumferential surface of the main body 100.

According to the present disclosure, the shampoo assisting device 50 is mounted on a wash basin 10, a bathtub, a sink, etc. with a simple configuration to allow the user to be shampooed while lying down. In addition, the shampoo assisting device can be detachably attached to a wash basin 10 so as to be used only during shampooing without interfering with the use of the wash basin 10, thereby providing the convenience during shampooing. In addition, the shampoo assisting device can stably support the neck and occipital region while the user is lying down so that the user's physical power consumption is reduced, thereby alleviating the physical discomfort or pain of the elderly or the infirm such as patients, and children. Furthermore, the shampoo assisting device can be used to support a part of the body of an infant during washing.

Although the preferred embodiments of the present disclosure have been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

The present disclosure is directed to a shampoo assisting device that is mounted on a wash basin, a bathtub, a sink, etc. with a simple configuration to allow the user to be shampooed while lying down.

The invention claimed is:

1. A shampoo assisting device comprising:
   - a main body having a locking part provided on one side of an upper portion and a headrest part provided on the other side of the upper portion to support a user's head;
   - a first support protruding from a lower portion of the main body so as to be closely supported by a bottom surface of a wash basin, the first support including a first tubular protrusion protruding from a first region of the lower portion; and
   - a second support provided on the lower portion of the main body so as to be closely supported on a step portion of the wash basin, the second support including a second tubular protrusion protruding from a second region of the lower portion.

2. The shampoo assisting device according to claim 1, wherein the locking part includes a concave neck support coupling portion at the upper center, wherein a neck support is coupled to the neck support coupling portion.

3. The shampoo assisting device according to claim 1, wherein the first support includes:
   - a first support member having a hook portion coupled to the first tubular protrusion.

4. The shampoo assisting device according to claim 3, wherein the first support member has a first suction plate on one end side thereof.

5. The shampoo assisting device according to claim 1, wherein the second support includes:
   - a second support member coupled to the second tubular protrusion; and
   - a second suction plate provided on the second support member.

6. The shampoo assisting device according to claim 1, wherein the locking part is provided on a lower side thereof with a fixing portion to be seated and supported on the step portion of the wash basin.

7. The shampoo assisting device according to claim 6, wherein the fixing portion includes:
   - a housing protruding from the lower portion of the main body;
   - a pad coupled to a lower portion of the housing; and an elastic member provided inside the housing so as to be elastically supported between the pad and the main body.

8. The shampoo assisting device according to claim 6, wherein the fixing portion includes:

a housing formed to protrude from the lower portion of the main body and having a fitting hole formed in a bottom surface thereof; and a pad having on an upper end side thereof a ball joint coupled to the fitting hole of the housing.

9. The shampoo assisting device according to claim 1, wherein the main body is further provided with a guard portion at an edge thereof.

* * * * *